US005090703A

United States Patent [19]

Koumarianos

[11] Patent Number: 5,090,703

[45] Date of Patent: Feb. 25, 1992

[54] GOLF SAND WEDGE AND PUTTER

[76] Inventor: Angelo N. Koumarianos, 248 24th Ave., South Seaside Park, N.J. 08752

[21] Appl. No.: 689,995

[22] Filed: Apr. 23, 1991

[51] Int. Cl.[5] ..... A63B 53/04

[52] U.S. Cl. ..... 273/175; 273/167 E; 273/168

[58] Field of Search ..... 273/167 R, 167 B, 167 E, 273/167 H, 167 J, 168, 175

[56] References Cited

U.S. PATENT DOCUMENTS

| | | | |
|---|---|---|---|
| 780,776 | 1/1905 | Brown | 273/175 |
| 1,437,463 | 12/1922 | Boye | 273/175 |
| 2,826,417 | 3/1958 | Marcoccio | 273/175 |
| 3,003,768 | 10/1961 | Clements | 273/175 |
| 4,165,076 | 8/1979 | Cella | 273/167 B |
| 4,461,482 | 7/1984 | Bojicic | 273/168 |
| 4,846,477 | 7/1989 | Phelan | 273/175 |
| 5,000,455 | 3/1991 | Beilfuss, Sr. | 273/175 |

FOREIGN PATENT DOCUMENTS

| | | | |
|---|---|---|---|
| 164609 | 6/1921 | United Kingdom | 273/167 B |

*Primary Examiner*—Edward M. Coven
*Assistant Examiner*—Steven B. Wong
*Attorney, Agent, or Firm*—Arthur L. Lessler

[57] ABSTRACT

A golf club for use as a sand wedge and as a putter, in which the ball-engaging face of the club head has a rectangular central opening through which sand can pass during a stroke while the club is used as a sand wedge. Upper and lower flat ramp surfaces are dimensioned, angled and spaced so as to contact the golf ball at intermediate portions between the outer and inner edges of the ramp surfaces. The upper and lower edges of the ramp surfaces are spaced apart by a distance approximately equal to the diameter of the golf ball to be driven, so as to avoid undesirable binding or cutting of the ball.

8 Claims, 1 Drawing Sheet

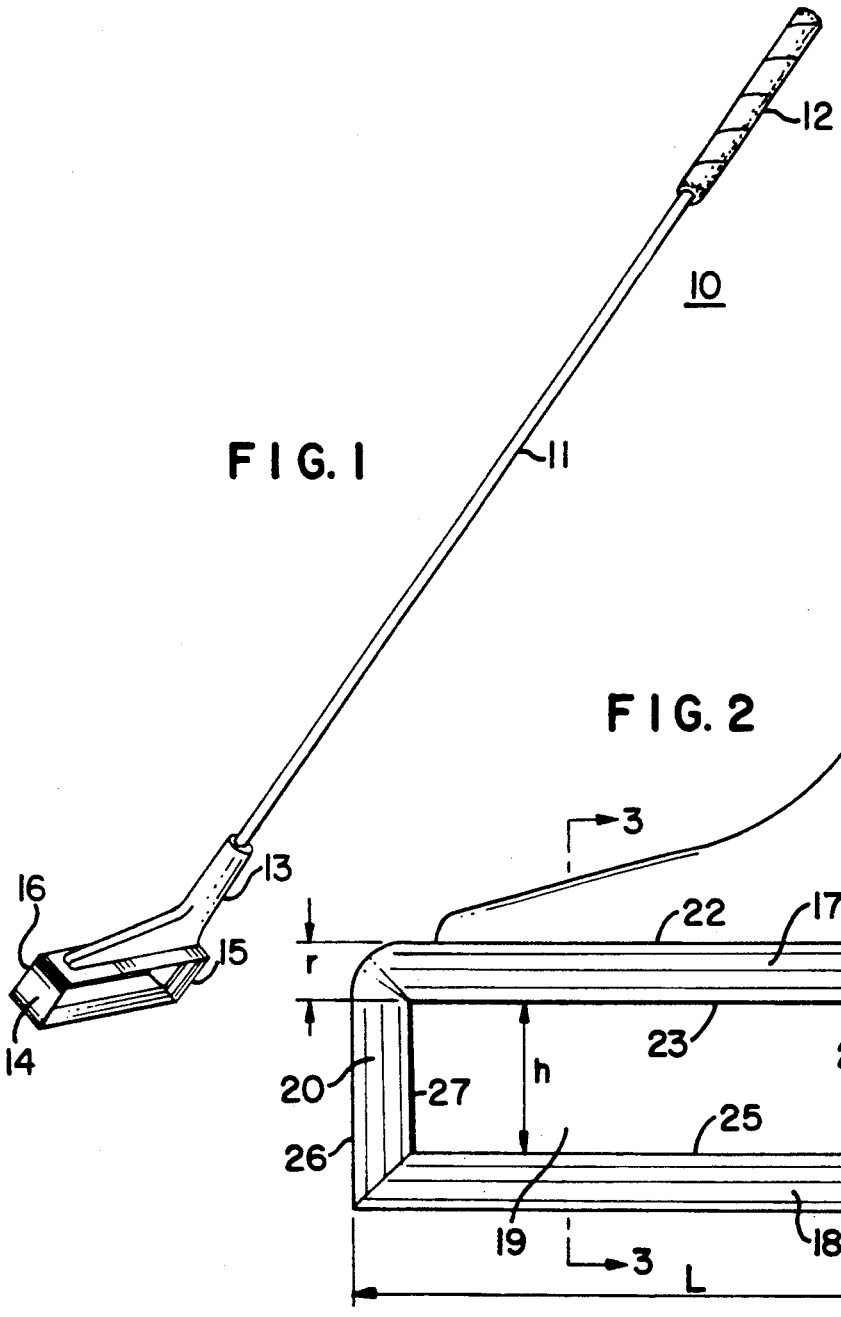
FIG. 1
FIG. 2
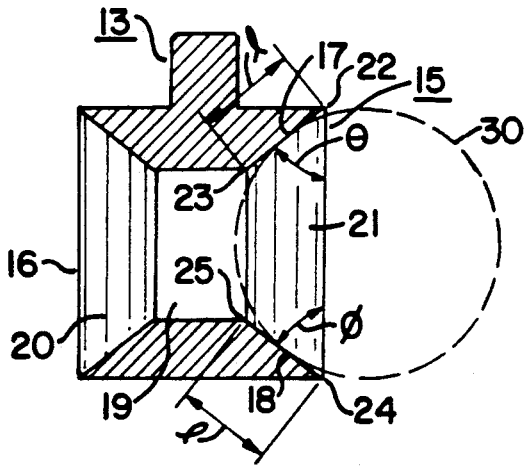
FIG. 3

GOLF SAND WEDGE AND PUTTER

BACKGROUND OF THE INVENTION

This invention relates to an improved golf club for use as both a sand wedge and a putter.

Various golf clubs have been designed with driving faces on the club head designed to increase the control of the golfer over the movement of the ball. Such designs include driving faces which are not flat.

For example, U.S. Pat. No. 4,653,756 to Sato discloses an iron with upper and lower wings oriented in the direction of the radial trajectory of the club head during the downswing of the club, in order to impart spin to the ball and minimize air flow turbulence during the swing.

U.S. Pat. No. 1,211,708 to Hudson shows a club with a generally concave striking face.

U.S. Pat. No. 1,674,173 to Haupt shows a club with a concave striking face, wherein the curvature of the face is progressive in the direction of flight of the ball.

U.S. Pat. No. 4,165,076 to Cella shows a putter with a concave striking face and an upper projection for providing a visual cue and for imparting spin to the ball.

U.S. Pat. No. 4,846,477 to Phelan shows a golf putter with a horizontal V-shaped groove for centering the golf ball.

An object of the present invention is to provide an improved golf sand wedge and putter which allows improved guidance of the golf ball and greater ease of driving the golf ball from sand traps, as compared to prior art golf clubs.

SUMMARY OF THE INVENTION

As herein described, there is provided a golf sand wedge and putter having a shaft with a handle portion at one end, and a club head at the opposite end. The club head comprises a body portion having a front ball-engaging face and a rear face. The ball-engaging face has upper and lower ball-engaging ramp parts and a recess between the ramp parts. Each of the ramp parts has an outer edge adjacent the front face and an inner edge adjacent the recess. The club head is adapted to engage a golf ball on surface portions of the ramp parts intermediate the inner and outer edges thereof.

IN THE DRAWING

FIG. 1 is an isometric view of a golf sand wedge and putter according a preferred embodiment of the present invention;

FIG. 2 is a front elevation view showing the club head and the ball-engaging front face of the golf club shown in FIG. 1; and FIG. 3 is a cross-sectional left side elevation view of the club head shown in FIG. 2, taken along the cutting plan 3—3 therein.

DETAILED DESCRIPTION

As seen in FIG. 1, the golf sand wedge and putter 10 comprises a shaft 11 having a handle portion 12 at one end thereof, and a club head 13 at the opposite end of the shaft.

The club head 13 comprises a body portion 14 having a front ball-engaging face 15 and a rear face 16.

The front ball-engaging face 15 has an upper ball-engaging flat ramp part 17, a lower ball-engaging flat ramp part 18, and a rectangular central hole 19 between the ramp parts 17 and 18. The hole 19 extends entirely through the body portion 14 between the faces 15 and 16 thereof.

The upper ramp part 17 and lower ramp part 18 are joined by a first lateral ramp part 20 and a second lateral ramp part 21 at the left and right sides of the ball-engaging front face 15 respectively.

Thus the front face 15 of the body portion 14 of the club head 13 has four ramp surfaces forming a truncated pyramidal section, viz. left, upper, right and lower flat ramp surfaces 20, 17, 21 and 18 respectively.

The rear face 16 of the body portion 14 of the club head 13 preferably has the same configuration as the front face 15 thereof, so that the club 10 can be used by both right-handed and left-handed players.

The upper ramp part 17 has an outer edge 22 defining a forward upper edge of the front face 15, and an inner edge 23 adjacent the central hole 19.

The lower ramp part 18 has an outer edge 24 defining a forward lower edge of the front face 15, and an inner edge 25 adjacent the central hole 19.

The left ramp part 21 has an outer edge 26, and an inner edge 27 adjacent the central hole 19.

The right ramp part 21 has an outer edge 28, and an inner edge 29 adjacent the central hole 19.

As best seen in FIG. 3, the upper and lower ramp parts 17 and 18 are spaced from each other a distance such that their outer edges 22 and 24 are spaced apart by a distance approximately equal to the diameter of a golf ball 30 to be driven by the club head 13.

As is also best seen in FIG. 3, the upper and lower ramp parts 17 and 18 have ramp surfaces which are inclined with respect to the front ball-engaging face 15 at angles $\theta$ and $\phi$ such that, when driven by the club head 13, the golf ball 30 may simultaneously contact a portion of each of the ramp parts 17 and 18 intermediate the inner and outer edges (22, 23 as to ramp part 17 and 24, 25 as to ramp part 18) thereof.

The upper and lower ramp surfaces 17 and 18 are preferably inclined at angles $\theta$, $\phi$ in the range of 45° to 60° with respect to the front ball-engaging face 15. The angles $\theta$ and $\phi$ are preferably equal, but may have different values within the aforementioned range.

In the preferred embodiment the height h of the central hole 19 is 1 inch, the distance between the upper and lower outer edges 22 and 24 is 1.75 inches, the height r of each of the ramp parts 17 and 18 is 0.375 inches, and the length .l of each of said ramp parts is 0.5 inches. The overall length L of the club face is preferably on the order of 4 inches.

The golf club is preferably made of an aluminum, magnesium or titanium alloy having a high strength-to-weight ratio.

When the club 10 is used as a sand wedge, the hole 19 allows the club face 15 to move through the sand with minimal resistance, as the sand flows through the central hole 19.

In the course of the stroke, the front ball-engaging face 15 contacts the ball 30 so that the areas of contact between the ball and club face are on intermediate portions of the ramp parts 17 and 18, preferably close to the middle of each ramp part as measured between the outer and inner edges thereof.

As previously stated, the upper and lower ramp part outer edges 22 and 24 should be spaced apart a distance approximately equal to the diameter of the golf ball. Smaller spacing than this results in a tendency of the outer edges of the ramp parts to cut the ball; whereas larger spacing results in undesirable binding action as the ball engages the inner edges 23 and 25 of the upper and lower ramp parts 17 and 18 respectively.

We claim:

1. A golf sand wedge and putter, comprising:

a shaft having a handle portion at one end; and a club head at the opposite end of the shaft, said club head comprising a body portion having a front ball-engaging face and a rear face, said front ball-engaging face having upper and lower ball-engaging ramp parts and a central hole between said ramp parts, said hole extending entirely through said body portion between the faces thereof, said upper ramp part having an outer edge defining a forward upper edge of said front face, and an inner edge adjacent said central hole, said lower ramp part having an outer edge defining a forward lower edge of said front face, and an inner edge adjacent said central hole, said upper and lower ramp parts being spaced from each other a distance such that the outer edges thereof are spaced apart by a distance approximately equal to the diameter of a golf ball to be driven by said club head, said upper and lower ramp parts having ramp surfaces inclined with respect to said front ball-engaging face at angles such that, when driven by the club head, the golf ball may simultaneously contact a portion of each of said ramp parts intermediate the inner and outer edges thereof.

2. The golf sand wedge and putter according to claim 1, wherein said central hole has a rectangular cross-section.

3. The golf sand wedge and putter according to claim 1, wherein each of said ramp surfaces is inclined at an angle in the range of 45° to 60° with respect to said front ball-engaging face.

4. The golf sand wedge and putter according to claim 1, 2 or 3, wherein each of said ramp surfaces is flat.

5. The golf sand wedge and putter according to claim 4, wherein said upper and lower ramp parts are so dimensioned and spaced apart that the golf ball may simultaneously contact portions of said ramp surfaces about halfway between the inner and outer edges thereof.

6. The golf sand wedge and putter according to claim 4, wherein said body portion of said club head has first and second lateral ramp parts joining said upper and lower ramp parts, so that said central hole is surrounded by said upper, lower and lateral ramp parts.

7. The golf sand wedge and putter according to claim 6, wherein one of said lateral ramp parts has an outer edge defining a forward left of said front face, and an inner edge adjacent said central hole, and the other of said lateral ramp parts has an outer edge defining a forward right edge of said front face, and an inner edge adjacent said central hole,

8. The golf sand wedge and putter according to claim 7, wherein said rear face of said body portion of said club head has four ramp surfaces oriented with respect to said rear face and each other, in the same way that said upper, lower left and right ramp surfaces are oriented with respect to said front face and to each other.

* * * * *